US006283717B1

(12) United States Patent
Yamada

(10) Patent No.: US 6,283,717 B1
(45) Date of Patent: Sep. 4, 2001

(54) CONTROL CIRCUIT OF A SOLENOID ACTUATED PUMP TO BE POWERED BY ANY VARIABLE VOLTAGE BETWEEN 90 AND 264 VOLTS

(75) Inventor: Ryuichi Yamada, Hyogo (JP)

(73) Assignee: Tacmina Corporation, Osaka (JP)

( * ) Notice: Subject to any disclaimer, the term of this patent is extended or adjusted under 35 U.S.C. 154(b) by 0 days.

(21) Appl. No.: 09/172,885

(22) Filed: Oct. 15, 1998

(30) Foreign Application Priority Data

Oct. 17, 1997 (JP) ..... 9-285370
Sep. 22, 1998 (JP) ..... 10-268475

(51) Int. Cl.[7] ..... F04B 49/06
(52) U.S. Cl. ..... 417/45
(58) Field of Search ..... 417/416, 45, 1, 417/44.1

(56) References Cited

U.S. PATENT DOCUMENTS 3,589,345 * 6/1971 Benson ..... 123/32 E
3,707,338 * 12/1972 Hilford ..... 417/416
3,853,477 * 12/1974 Block et al. ..... 23/254 R
3,985,133 * 10/1976 Jenkins et al. ..... 128/214 F
4,046,137 * 9/1977 Curless et al. ..... 128/1 D
4,381,181 * 4/1983 Clegg ..... 417/423
4,405,063 * 9/1983 Wydro et al. ..... 222/146 HE
4,431,095 * 2/1984 Suga ..... 192/3.31
4,764,165 * 8/1988 Reimels et al. ..... 604/35
4,773,302 * 9/1988 Mizota et al. ..... 91/361
5,036,422 * 7/1991 Uchida et al. ..... 361/159
5,362,209 * 11/1994 Day ..... 417/293
5,758,862 * 6/1998 Sturman ..... 251/25
5,825,975 * 10/1998 Privas ..... 392/404
5,965,089 * 10/1999 Jarvik et al. ..... 422/44

OTHER PUBLICATIONS

Kurt L. Kosbar, University of Missouri—Rolla, Electrical Engineering Dept., "Analog to Digital Converter Basics". http://www.siglab.ee.umr.edu/ee341/dsp/ADDA/ad.html, Jan. 1998.*

* cited by examiner

*Primary Examiner*—Timothy S. Thorpe
*Assistant Examiner*—Ehud Gartenberg
(74) *Attorney, Agent, or Firm*—Arent Fox Kintner Plotkin & Kahn, PLLC

(57) ABSTRACT

A control circuit of a solenoid actuated pump includes an energizing means for energizing a solenoid of the solenoid actuated pump, a detecting means for detecting the electrical energy of a power supply for supplying the electrical energy to the energizing means, and a processing unit for comparing the value of the electrical energy detected by the detecting means with a predetermined value to be supplied to the solenoid and supplying a control signal to the energizing means so as to adjust the detected value of the electrical energy to the predetermined value.

12 Claims, 5 Drawing Sheets

1
2
XMFR
3
RECTIFIER
4
RECTIFIER
5
DETECTOR (A/D CONV.)
6
PROCESSING CIRCUIT
7
ENERGIZING CIRCUIT
8
SOLENOID
9
CONTROL
10
11
DATA SUPPLY UNIT
12
CONTROL CIRCUIT

CONTROL CIRCUIT OF A SOLENOID ACTUATED PUMP TO BE POWERED BY ANY VARIABLE VOLTAGE BETWEEN 90 AND 264 VOLTS

BACKGROUND OF THE INVENTION

1. Field of the Invention

The present invention relates to a control circuit of a solenoid actuated pump, and more particularly a control circuit of a solenoid actuated pump capable of regulating an electrical energy supplied to a solenoid.

2. Discussion of the Background

There have been proposed various types of solenoid actuated pumps. FIG. 20 illustrates an example of basic arrangements of a control circuit used for the solenoid actuated pumps, in which a solenoid 8 is connected at a terminal 8*a* of one end thereof to a DC power, and is provided at the opposite end thereof with a switch 12 coupled to a pulse generating circuit 11 with a pulse whose ON time is invariable and ON cycle (frequency) is variable. With this arrangement, current is intermittently supplied to the solenoid 8 by operating the switch 12 in response to a pulse signal.

In accordance with a conventional control circuit of the solenoid actuated pump as described above, the range of an applicable DC power connected to the terminal 8*a* of the solenoid 8 and that of an applicable voltage for the pulse generating circuit 11 depend on the capacity of the switch 12. Specifically, the arrangement that the control circuit includes the switch 12 corresponding to supply voltage necessitates the replacement of an energizing circuit and a solenoid to those corresponding to a different supply voltage. Therefore, this arrangement poses a problem that various types of the control circuits are needed, thereby rendering the inventory management difficult.

In addition, as described above, the arrangement that the control circuit and the solenoid correspond to supply voltage may poses problems, for example, malfunction and burning of the control circuit caused by an improper supply voltage.

The above arrangement poses another problem that a user is required to handle various types of the pumps and control circuits, rendering the inventory management difficult and costly.

It is an object of the present invention to provide a control circuit of a solenoid actuated pump capable of eliminating a troublesome work to select supply voltage by a user for every application.

SUMMARY OF THE INVENTION

According to one aspect of the present invention, there is provided a control circuit of a solenoid actuated pump including an energizing means for energizing a solenoid of the solenoid actuated pump, a detecting means for detecting the electrical energy of a power supply for supplying the electrical energy to the energizing means, and a processing unit for comparing the value of the electrical energy detected by the detecting means with a predetermined value to be supplied to the solenoid and supplying a control signal to the energizing means so as to adjust the detected value of the electrical energy to the predetermined value.

In accordance with the control circuit of the above arrangement, the detecting means detects the electrical energy of the power supply. The processing unit, then, compares the value of the electrical energy detected by the detecting means with the predetermined value of the electrical energy and supplies the control signal to the energizing means so as to supply the predetermined value of the electrical energy suitable for the energizing means. Therefore, even in case of that the power supply does not supply an electrical energy, for example, a voltage unsuitable for energizing the solenoid, such an electrical energy can be transformed to the predetermined value before being supplied to the solenoid.

When the voltage is a parameter of the electrical energy to be detected by the detecting means, the detecting means may preferably be constituted by using a voltage comparator with a reference voltage provided thereto, to which the voltage is supplied.

Alternatively to the above arrangement of the detecting means for detecting the voltage, the detecting means may preferably be constituted by using a voltage comparator with a reference voltage provided thereto and a voltage dividing circuit, in which the voltage is supplied to the voltage comparator via the voltage dividing circuit.

As another arrangement of the detecting means for detecting the voltage, the detecting means may preferably be constituted by using a processing circuit with a reference voltage provided thereto, to which the voltage is supplied.

When the voltage is a parameter of the electrical energy to be detected by the detecting means in accordance with the control circuit of the present invention, the processing unit may preferably be constituted by using a voltage comparator with a reference voltage provided thereto and a half wave and full wave switching circuit. With this arrangement, the voltage is supplied to the voltage comparator, in which the voltage supplied to the voltage comparator is compared with the reference voltage. The half wave and full wave switching circuit is then controlled in accordance with the compared result provided by the voltage comparator so as to supply a control signal, thereby adjusting the value of the voltage representative of the value of the electrical energy to the predetermined value.

Alternatively to the above arrangement of the processing unit in case of detecting the voltage as a parameter of the electrical energy, the processing unit may preferably be constituted by using a voltage comparator with a reference voltage provided thereto, a voltage dividing circuit, a NOR circuit and a pulse generator. With this arrangement, the voltage is supplied via the voltage dividing circuit to the voltage comparator, which voltage comparator compares the voltage supplied thereto with the reference voltage, and then supplies a signal to the NOR circuit in accordance with the compared result so as to control the NOR circuit in cooperation with a signal from the pulse generator. The NOR circuit, then, supplies a control signal, upon which the value of the voltage representative of the value of electrical energy is adjusted to the predetermined value.

As another arrangement, the processing unit, in case of detecting the voltage as a parameter of the electrical energy, may preferably be constituted by using a processing circuit with a reference voltage provided thereto, a duty variable transmitter, an AND circuit and a pulse generator. With this arrangement, the voltage is supplied to the processing circuit, which processing circuit compares the voltage supplied thereto with the reference voltage. The duty variable transmitter is then controlled in accordance with the compared result provided by the processing circuit to supply a signal to the AND circuit so as to control the AND circuit in cooperation with a signal from the pulse generator. The AND circuit then supplies a control signal, upon which the value of the voltage representative of the value of the electrical energy is adjusted to the predetermined value.

In accordance with the control circuit of the solenoid actuated pump of the present invention, the energizing means may preferably be constituted by using an energizing circuit, and alternatively may preferably be constituted by using a condenser and a discharge control switch.

According to another aspect of the present invention, there is provided a control circuit of a solenoid actuated pump including an energizing circuit for energizing a solenoid of the solenoid actuated pump, a detecting means for detecting voltage of a power supply for supplying the voltage to the energizing circuit, and a processing unit for comparing the voltage detected by the detecting means with a predetermined voltage to be supplied to the solenoid and supplying a control signal to the energizing circuit so as to adjust the detected voltage to the predetermined voltage.

In accordance with the control circuit of the above arrangement, the detecting means detects the voltage of the power for supply supplying the voltage to the energizing circuit. The processing unit, then, compares the voltage detected by the detecting means with the predetermined voltage and supplies the control signal to the energizing circuit so as to supply the predetermined voltage suitable for energizing the energizing circuit. Therefore, even in case of that the power supply supplies a voltage unsuitable for energizing the solenoid, such a voltage can be transformed to the predetermined voltage before being supplied to the solenoid.

BRIEF DESCRIPTION OF THE DRAWINGS

The above, and other objects, features and advantages of the present invention will become apparent from the detailed description thereof in conjunction with the accompanying drawings wherein.

DETAILED DESCRIPTION OF THE PREFERRED EMBODIMENT

Embodiment 1

Figure 1:
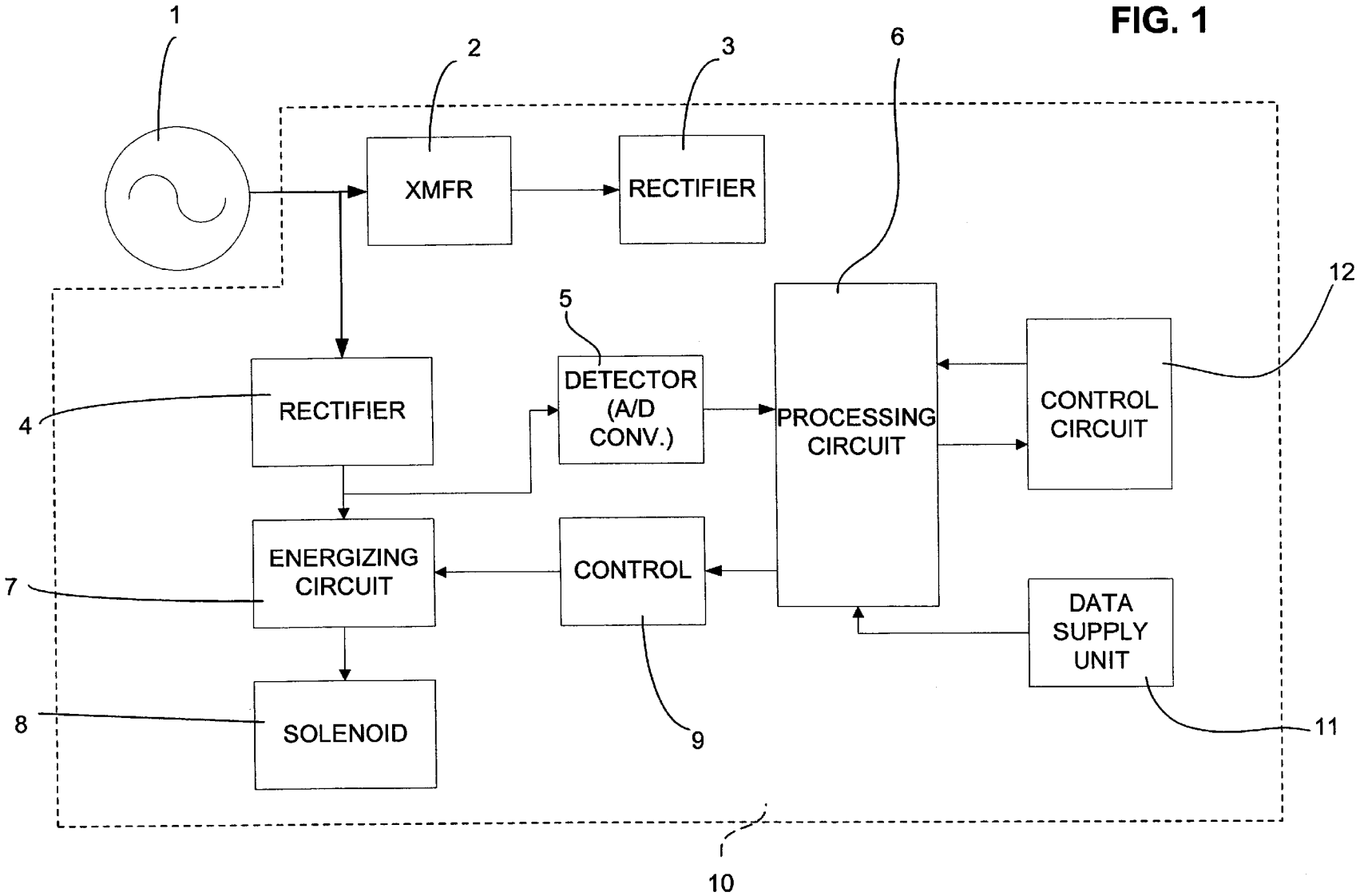
FIG. 1 is a block diagram illustrating a control circuit of a solenoid actuated pump in accordance with a first embodiment of the present invention.

Referring to FIG. 1, a reference numeral 1 designates a power supply of an alternating voltage. The voltage that can be supplied by the power supply 1 is set in this embodiment to lie, for example, in the range between 90 to 264 volts.

Reference numeral 2 designates a transformer for transforming the voltage to the alternating low voltage of about one tenth as much as the voltage of the power supply 1, for example, about 24 volts to supply the voltage of the power supply 1 to a processing unit 6. Reference numeral 3 designates a rectifying circuit that is constituted by, for example, a diode to rectify the voltage from the transformer 2 to a direct voltage and simultaneously stabilize the voltage.

Reference numeral 4 designates a rectifying circuit that is constituted by, for example, a diode to generate a direct voltage for energizing a solenoid 8. A detecting means 5 includes a detecting unit for dividing the voltage from the rectifying circuit 4, transforming the voltage to, for example, about 0 to 5 volts, and detecting the transformed voltage, and an analog-to-digital converter for converting the detected voltage to a digital signal. In this embodiment, the detecting means 5 will be hereinbelow referred as "analog-to-digital converting unit", or more simply "A/D converting unit."

Since the A/D converting unit 5 divides the voltage from the rectifying circuit 4 and transforms the same to about 0 to 5 volts at the detecting unit, an A/D converting unit of the type that cannot be used for a high voltage can be used.

Reference numeral 6 designates a processing unit which is energized by the direct voltage from the rectifying circuit 3, and inputted a digital signal from the AID converting unit 5, specifically a digitized value of supply voltage. The processing unit 6 of this embodiment is constituted by, for example, a CPU. The processing unit 6 is electrically connected to a control unit 9 capable of controlling the operation of the pump, and connected to a data supplying unit 11, for example, a ROM capable of supplying a previously stored set value, for example, an energizing voltage.

The processing unit 6 and the rectifying circuit 4 are electrically connected to the energizing circuit 7 as the energizing means of this embodiment that is, in turn coupled to a solenoid 8 to energize the solenoid 8 by supplying the voltage.

Thus, a control circuit 10 of a solenoid actuated pump includes the transformer 2, the rectifying circuits 3 and 4, the A/D converting unit as the detecting means, the processing unit 6, the energizing circuit 7 as the energizing means, the solenoid 8, and the control unit 9. The operation of the control circuit 10 will be described hereinbelow.

The alternating voltage from the power supply 1 is divided into the transformer 2 and the rectifying circuit 4. The transformer 2 steps down the voltage, and then supplies the stepped-down voltage to the rectifying circuit 3. The rectifying circuit 3 then rectifies the voltage of the power supply 1 to direct voltage and supplies the rectified voltage to the processing unit 6.

On the other hand, the direct voltage from the rectifying circuit 4 is supplied to the A/D converting unit 5 so as to be converted to a digital signal (hereinbelow referred as an input value), and then inputted to the processing unit 6. An energizing voltage (hereinbelow referred as a set value) is inputted from the data supplying unit 11, for example, the ROM to the processing unit 6, to which a signal for running and stopping the pump from a second control unit 12 (e.g., an on-off switching operation by an operator), or a signal representative of the preset number of strokes or the like is also inputted. The control unit 6, then, supplies a control signal to a control unit 9 in accordance with those signals.

The processing unit 6 inputs a signal representative of the direct voltage (e.g., a signal proportional to the direct voltage) inputted thereto to the control unit 12 to monitor the signal representative of the direct voltage. The second control unit 12 checks the solenoid 8 whether or not a failure such as a burnout has occurred. When the failure has been detected, the second control unit 12 sends a signal to the processing unit 6 so as to stop the pump. The processing unit 6, then, inputs a control signal to the control unit 9 so as to adjust the voltage to be applied to the solenoid 8 in accordance with the signal from the second control unit 12, and then stop the pump.

On the contrary, when no failure has been detected in the solenoid, the second control unit 12 runs the pump and sends a control signal to the processing unit 6 so as to control an on-off cycling. The processing unit 6 adjusts the input value from the A/D converting unit 5, and sends a control signal for controlling an on-off duty ratio to the control unit 9 so as to adjust the energizing voltage for energizing the solenoid 8 to the set value.

The processing unit 6, thus, generates a control unit directed signal to be supplied to the control unit 9 controlling the energizing circuit 7, in accordance with the above-mentioned control signal for running and stopping the pump, or controlling the on-off cycling. In other words, the control signal from the processing unit 6 can be supplied to the energizing circuit 7 via the control unit 9.

The control unit directed signal is transmitted from the control unit 9 to the energizing circuit 7 for energizing the solenoid 8, while the direct voltage of the power supply 1 from the rectifying circuit 4 is applied to the energizing circuit 7. That is, the energizing circuit 7 is supplied with the direct voltage of the power supply 1, and simultaneously with the control unit directed signal from the control unit 9.

Accordingly, the energizing circuit 7 amplifies the control unit directed signal generated by the control unit 9, and controls the energizing voltage for energizing the solenoid 8, so that a suitable voltage for energizing the solenoid 8 can be supplied to the solenoid 8. Instead, the control signal for stopping the pump permits the energizing circuit 7 not to supply the energizing voltage to the solenoid 8.

The control circuit directed signal to be supplied from the control unit 9 to the energizing circuit 7 is a signal for controlling the on-off duty ratio by switching the direct voltage supplied from the rectifying circuit 4 to the solenoid 8. Specific controlling methods include a pulse width modulation mode and a phase modulation mode.

In accordance with this embodiment, the processing unit 6 compares the voltage from the power supply 1 with a predetermined voltage, and the control unit directed signal is supplied from the control unit 9 to the energizing circuit 7, permitting the energizing circuit 7 to supply a predetermined voltage to the solenoid 8. Thus, even if the voltage of the power supply 1 is not suitable for energizing the solenoid 8, the voltage to be supplied to the energizing circuit 7, and then to the solenoid 8 can be transformed to a voltage suitable for energizing the solenoid 8. This permits one type of the control circuit to cope with the power supply of varying voltage without the necessity of the replacement of the control circuit 10 incorporating the energizing circuit 7 designed for a different power supply 1.

Therefore, the control circuit 10 of the above arrangement can advantageously eliminate the necessity to regulate the supply voltage or performs other associated operations by a user, and therefore eliminate a troublesome work to adjust the supply voltage.

The control circuit of this embodiment is also advantageous in the fact that, since one type of the control circuit can sufficiently cope with the power supply of varying voltage, a different type of the control circuit 10 is not required, and the necessity to select the control circuit for a different power supply can be eliminated. Therefore, it is possible to avoid various troubles such as malfunction or burning of the control circuit and the solenoid caused by using an improper control circuit, thereby achieving ease of inventory management.

The control circuit of this embodiment regulates the energizing voltage by controlling the duty of the energizing voltage of the solenoid, so that it can be generally applied to the arrangement, in which the power supply is not equipped with a function to stabilize the voltage for energizing the solenoid.

In this embodiment, the CPU is used as the processing unit. However, various components can properly be used, provided that they can compare the voltage detected by the A/D converting unit 5 with a predetermined voltage to be supplied to the solenoid 8, and supply a control signal to the energizing circuit 7 so as to adjust the detected voltage to the predetermined voltage, or can switch the direct voltage of the energizing circuit 7.

In this embodiment, the case that the set value of the energizing voltage is stored in the processing unit has been described. However, the place where the set value is stored is not limited to the processing unit, and therefore the set value may be stored in a ROM or other external memory elements. In case of storing the set value in the ROM or the like, the set value can easily be varied only by replacing the ROM or the like with a new one. This arrangement can also be applied to the following embodiments.

Embodiment 2

Figure 2:
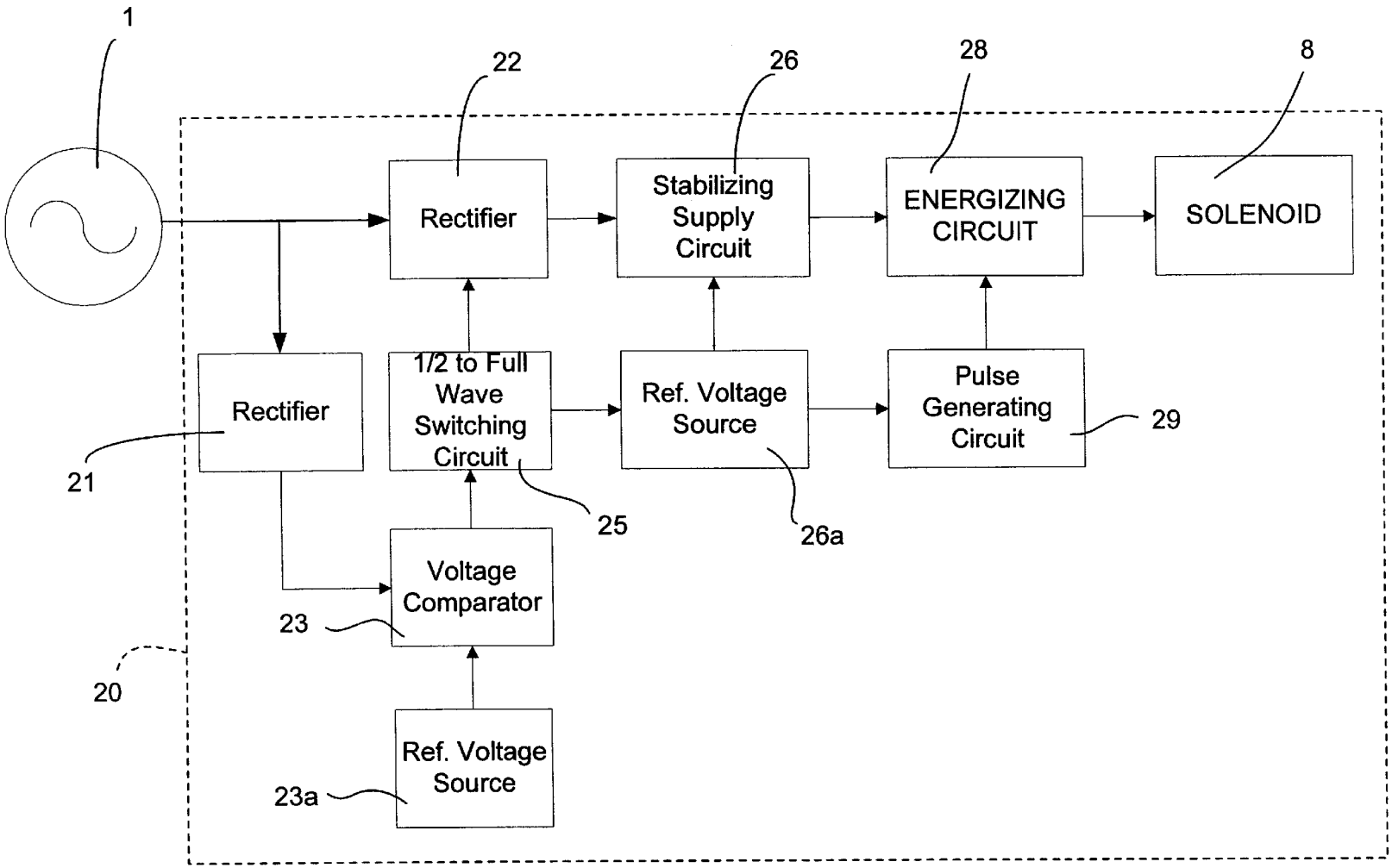
FIG. 2 is a block diagram illustrating a control circuit of a solenoid actuated pump in accordance with a second embodiment of the present invention.

Referring to FIG. 2, reference numeral 1 designates a power supply of an alternating voltage. The voltage that can be supplied by the power supply 1 is set in this embodiment to lie, for example, in the range between 90 to 264 volts.

Reference numeral 21 designates a rectifying circuit for rectifying the voltage of the power supply 1 to supply the same to a voltage comparator. In this regard, the voltage from the power supply 1 is supplied to the voltage comparator via the rectifying circuit 21. However, a step-down circuit may be disposed at the upstream side of the rectifying circuit 21, and a smoothing circuit may be disposed at the downstream side of the rectifying circuit 21 depending on the situation. With this arrangement, the voltage from the power supply 1 is supplied to the voltage comparator via the step-down circuit, the rectifying circuit and the smoothing circuit.

Reference numeral 22 designates a rectifying circuit constituted by, for example, a diode for generating the direct voltage energizing the solenoid 8.

Reference numeral 23 designates the aforementioned voltage comparator for comparing the voltage of the power supply 1 supplied from the rectifying circuit 21 with a reference voltage 23*a*. DC5V is assigned to the reference voltage 23*a* in this embodiment.

Reference numeral 25 designates a half wave and full wave switching circuit for switching the rectifying circuit 22 in accordance with the compared result provided by the voltage comparator 23. Specifically, under the state that the reference voltage 23*a* has been provided to the voltage comparator 23, the half wave and full wave switching circuit 25 switches the rectifying circuit 22 for rectifying the voltage supplied to the solenoid 8 in such a manner as to rectify the voltage on the full wave basis in case of that the voltage of the power supply 1 is in the order of 100 volts (e.g., 90 to 165 volts), and rectify the voltage on the half wave basis in case of that the voltage of the power supply 1 is in the order of 200 volts (e.g., 165 to 264 volts).

The above description was made for the arrangement, where the supplied voltage is classified into two regions, specifically the region of 90 to 165 volts and the region of 165 to 264 volts, and the switching is performed to rectify the voltage on the half wave basis or the full wave basis in accordance with the corresponding region. However, this embodiment is not limited to this arrangement. The supplied voltage may be classified into, for example, three regions of 90 to 144 volts, 144 to 180 volts and 180 to 264 volts to control the half wave and full wave switching circuit 25. Specifically, it may be preferable to employ the arrangement where the voltage is rectified on the full wave basis for the region of 90 to 144 volts and on the half wave basis for the region of 180 to 264 volts, and the output of the voltage from the half wave and full wave switching circuit 25 is stopped for the region of 144 to 180 volts.

Since many power supplies actually used are designed to supply the voltage of the region near 100 volts (90 to 144 volts), or the region near 200 volts (180 to 264 volts), the above arrangement become suitable, particularly for the case that a stabilizing supply circuit 26 with a relatively low capacity is to be used. Even in this case, the control circuit of the solenoid actuated pump can be constituted. The arrangement where the voltage is classified into the three regions requires an additional voltage comparator and the associated parts.

Reference numeral 26 designates the aforementioned stabilizing supply circuit, to which a pulsating current power that has been rectified on the half wave basis or the full wave basis in accordance with the voltage of the power supply 1 is supplied. The output voltage of the stabilizing supply circuit 26 is stabilized by the reference voltage 26*a*. In the stabilizing supply circuit 26, an excessive energy is transformed to heat or the like and released to stabilize the energy from the power supply 1. DC5V is assigned to the reference voltage 26*a* in this embodiment.

In this embodiment, the description was made for the case where the pulsating current power is directly supplied to the stabilizing supply circuit 26. However, there may be disposed a smoothing circuit between the rectifying circuit 22 and the stabilizing supply circuit 26 depending on the situation, so that the pulsating current power is supplied to the stabilizing supply circuit 26 via the smoothing circuit.

Reference numeral 28 designates an energizing circuit for energizing the solenoid 8, which energizing circuit is coupled to a pulse generating circuit 29, which outputs an energizing pulse whose ON time is invariable and OFF time is variable. The switching of the energizing circuit 28 is performed by using this energizing pulse.

In accordance with the embodiment as illustrated in FIG. 2, a detecting means for detecting the voltage is constituted by using the voltage comparator 23 with the reference voltage 23*a* provided thereto. In addition to this, it may be conceivable that the combination of the rectifying circuit 22 and its associated components (e.g., a step-down circuit and a smoothing circuit) acts as the detecting means. The processing unit is constituted by using the voltage comparator 23 with the reference voltage 23*a* provided thereto and the half wave and full wave switching circuit 25.

In accordance with this embodiment, the voltage from the power supply 1 is compared with the reference voltage 23*a* by the voltage comparator 23, and the voltage is, then, rectified on the half wave basis or the full wave basis in accordance with the compared result provided by the voltage comparator 23 so as to control the voltage to be supplied to the energizing circuit 28. That is, it is possible to regulate the supply voltage to be supplied to the solenoid 8, or more specifically to the energizing circuit 28 for energizing the solenoid 8 by using a control circuit 20 illustrated in FIG. 2.

In accordance with this embodiment, the voltage from the power supply 1 is compared with the reference voltage 23*a* by the voltage comparator 23, and the rectifying circuit 22 is controlled in accordance with a signal from the half wave and full wave switching circuit 25 so that the energizing circuit 28 can supply a predetermined voltage to the solenoid 8. With this arrangement, the rectifying circuit 22 is controlled in accordance with a signal from the half wave and full wave switching circuit 25, so that the voltage supplied to the energizing circuit 28 can be supplied to the solenoid 8 after transformed to a predetermined voltage.

That is, in the same manner as that of the control circuit of the first embodiment, it is not necessary to prepare a varying type of the control circuit 20 of this embodiment for coping with the power supply of varying voltage, so that the regulation or any other adjustments of the supply voltage by an user can be eliminated, and therefore a troublesome work to adjust the supply voltage can be eliminated.

Further, one type of the control circuit 20 can sufficiently cope with the power supply of varying voltage, so that a different type of the control circuit 20 is not required, thereby eliminating the necessity to select the control circuit for a different power supply. Therefore, it is possible to avoid various troubles such as malfunction and burning of the control circuit and the solenoid due to an incorrect control circuit, thereby achieving ease of inventory management.

Embodiment 3

Figure 3:
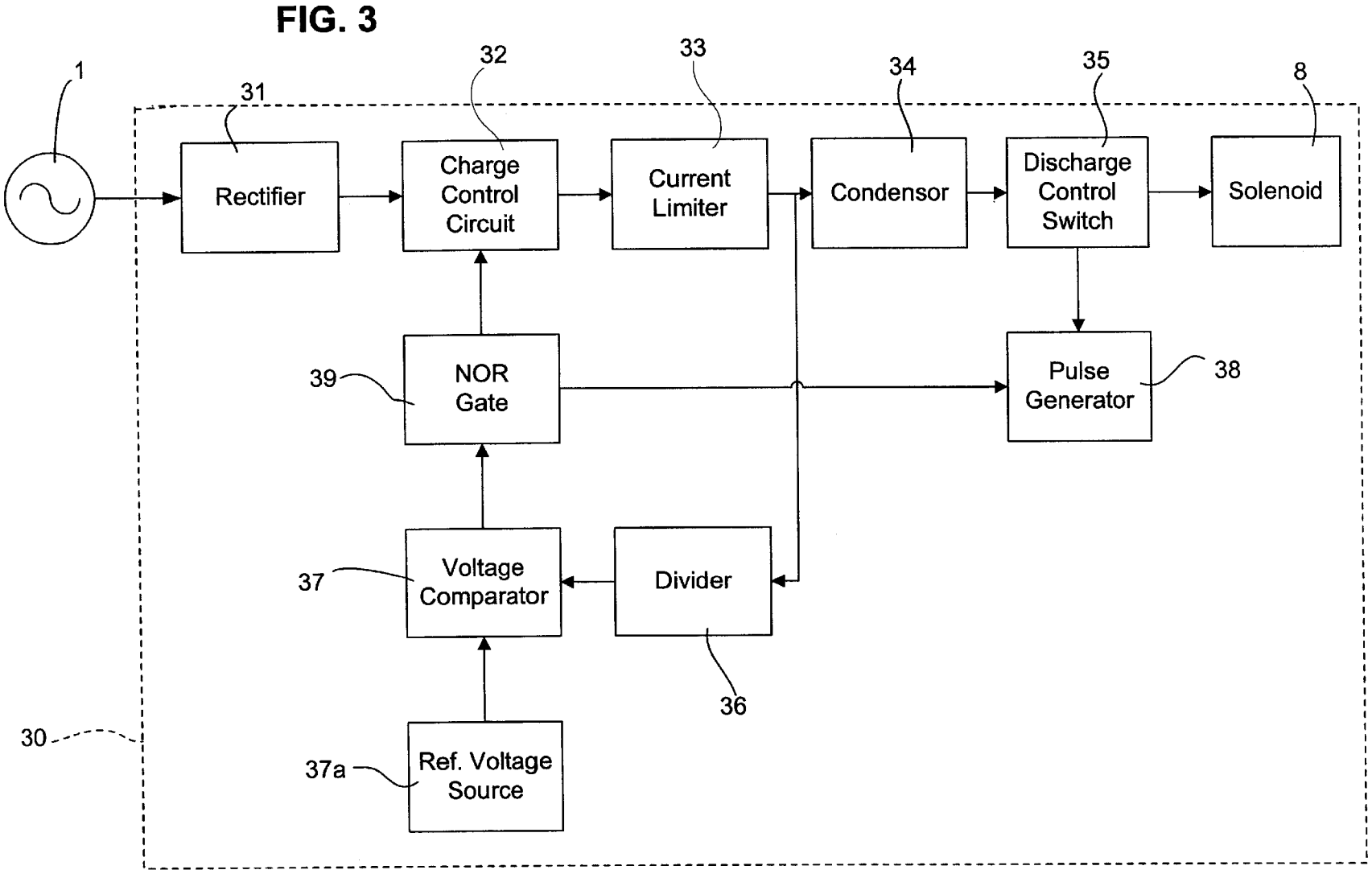
FIG. 3 is a block diagram illustrating a control circuit of a solenoid actuated pump in accordance with a third embodiment of the present invention.

Referring to FIG. 3, a reference numeral 1 designates a power supply of an alternating voltage. The voltage that can be supplied by the power supply 1 is set in this embodiment to lie, for example, in the range between 90 to 264 volts. Reference numeral 31 designates a rectifying circuit constituted by, for example, a diode or the like to generate a direct voltage for energizing the solenoid 8.

In this embodiment, the direct voltage rectified by the rectifying circuit 31 from the alternating voltage of the power supply 1 is transmitted through a charging control switch 32 and a current limiting circuit 33, and is charged in a condenser 34, to which a voltage dividing circuit 36 is coupled in such a manner as to lead the voltages outputted from both terminals of the condenser 34 to the voltage comparator 37. Further, the voltage comparator 37is provided with a reference voltage 37*a*. Specifically, the voltage comparator 37 compares the voltage of the condenser 34 with the reference voltage 37*a* to monitor the voltage of the condenser 34. DC5V is assigned to the reference voltage 37*a* in this embodiment.

The condenser 34 is coupled to a discharge control switch 35 capable of opening and closing in accordance with a signal of a pulse generator 38 so as to supply the direct voltage charged in the condenser 34 to the solenoid 8.

In accordance with the embodiment as illustrated in FIG. 3, the output of the voltage comparator 37 and the output of the pulse generator 38 are led to a NOR circuit 39, which controls the charging control switch 32 in accordance with the compared value of the voltage comparator 37 supplied to the NOR circuit 39 and the value from the pulse generator 38. Thus, a constant charging amount of the condenser 34 is maintained by controlling the charging control switch 32 by the NOR circuit 39.

In accordance with this embodiment as illustrated in FIG. 3, the detecting means for detecting the voltage is constituted by using the voltage comparator 37 with the reference voltage provided thereto and the voltage dividing circuit 36. The detecting means may be constituted by adding the current limiting circuit 33 and its associated parts to the voltage comparator 37 and the voltage dividing circuit 36. The processing unit is constituted by using the voltage comparator 37 with the reference voltage provided thereto, the voltage dividing circuit 36 and the NOR circuit 39. Further, the energizing means is constituted by using the condenser 34 and the discharge control switch 35.

As described above, in accordance with this embodiment, the voltage comparator 37 compares the voltage charged in the condenser 34 with the reference voltage 37*a* to supply the compared result to the NOR circuit 39. The NOR circuit 39 is supplied with the value from the voltage comparator 37 and the value from the pulse generator 38, and controls the charging control switch 32 for controlling the charging amount of the condenser in accordance with these values. That is, the control circuit 30 of FIG. 3 can regulate the energy supplied to the solenoid.

Accordingly, in the same manner as that of the control circuits of the first and second embodiments, it is not necessary to prepare a varying type of the control circuit 30 of this embodiment for coping with the power supply of varying voltage, so that the regulation or any other adjustments of the supply voltage by an user can be eliminated, and therefore a troublesome work to adjust the supply voltage can be eliminated.

Further, one type of the control circuit 30 can sufficiently cope with the power supply of varying voltage, so that a different type of the control circuit 30 is not required, thereby eliminating the necessity to select the control circuit for a different power supply. Therefore, it is possible to avoid various troubles such as malfunction and burning of the control circuit and the solenoid due to an incorrect control circuit, thereby achieving ease of inventory management.

Embodiment 4

Figure 4:
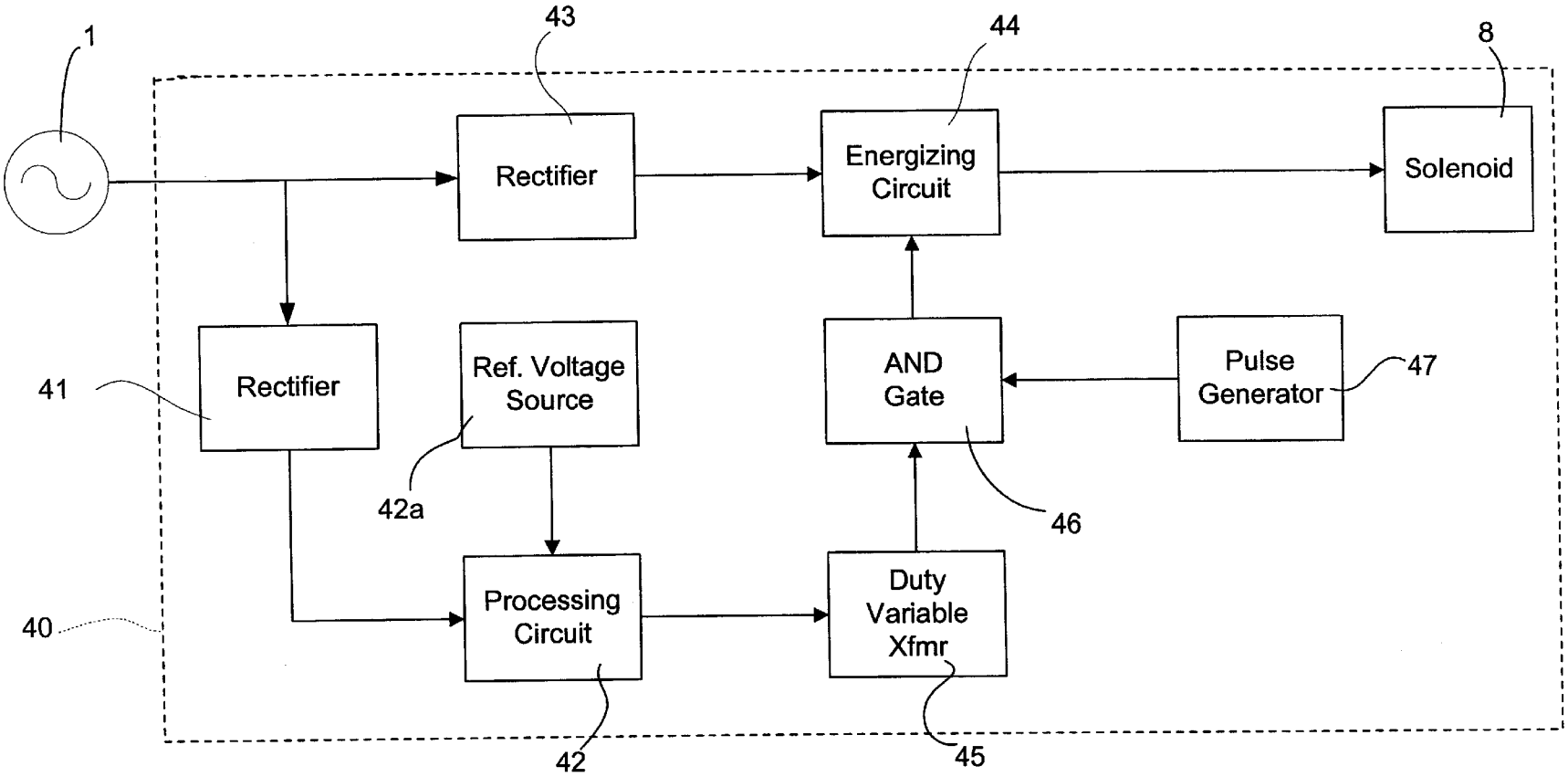
FIG. 4 is a block diagram illustrating a control circuit of a solenoid actuated pump in accordance with a fourth embodiment of the present invention.
Figure 5:
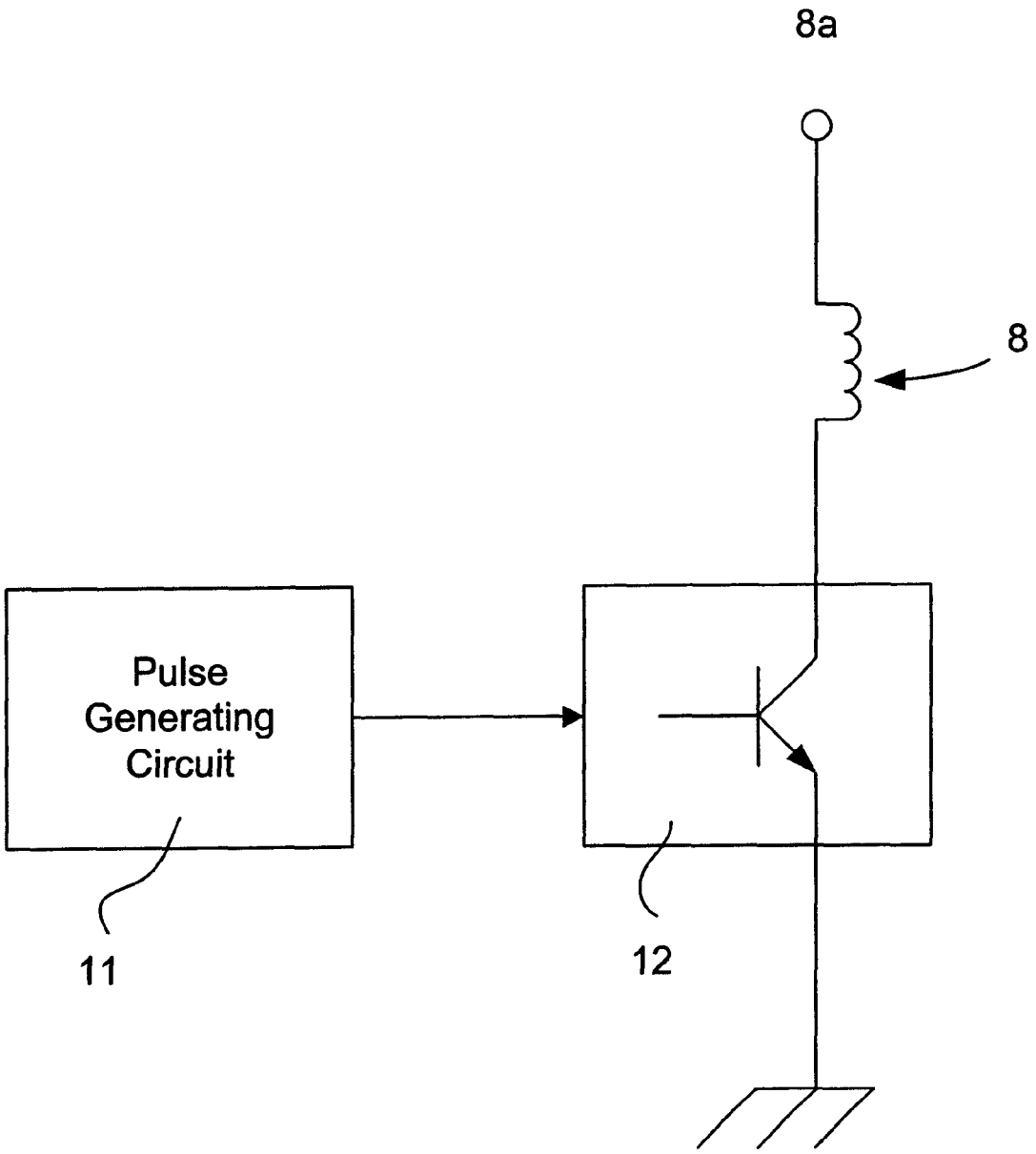
FIG. 5 PRIOR ART
FIG. 5 is a block diagram illustrating an example of a conventional solenoid actuated pump.

Referring to FIG. 4, reference numeral 1 designates a power supply of an alternating voltage. The voltage that can be supplied by the power supply 1 is set in this embodiment to lie, for example, in the range between 90 to 264 volts. Reference numeral 41 designates a rectifying circuit for rectifying the voltage of the power supply 1 to supply the same to a processing circuit.

In this embodiment, the voltage from the power supply 1 is supplied to the processing circuit via the rectifying circuit 41. However, a step-down circuit may be disposed at the upstream side of the rectifying circuit 41, and a smoothing circuit may be disposed at the downstream side of the rectifying circuit 41. With this arrangement, the voltage is supplied from the power supply 1 to the processing circuit via the step-down circuit, the rectifying circuit 41 and the smoothing circuit.

Reference numeral 42 designates the aforementioned processing circuit, to which a reference voltage 42*a* has been provided. The processing circuit 42 controls a duty variable transmitter. DC5V is assigned to the reference voltage 37*a* in this embodiment.

Reference numeral 43 designates a rectifying circuit constituted by, for example, a diode or the like to generate a direct voltage for energizing the solenoid 8. Reference numeral 44 designates an energizing circuit as an energizing means for energizing the solenoid 8. The rectifying circuit 43 is coupled to the energizing circuit 44 to supply the direct voltage for energizing the solenoid therefrom to the energizing circuit 44. The energizing circuit 44 is also supplied with a control signal from an AND circuit.

In accordance with this embodiment as illustrated in FIG. 4, a detecting means for detecting the voltage is constituted by using the processing circuit 42 with the reference voltage 42*a* provided thereto. However, depending on situation, it may be conceivable that the detecting means is constituted by using the rectifying circuit 41 and its associated components in addition to the processing circuit 42.

The processing unit is constituted by using the processing circuit 42 with the reference voltage 42*a* provided thereto, a duty variable transmitter 45 and an AND circuit 46. The duty variable transmitter 45 includes a device using a PWM (pulse width modulation) mode, a FM (frequency modulation) mode, a PM (phase modulation) mode or the like.

In accordance with this embodiment, the processing circuit 42 is supplied with the voltage from the rectifying circuit 41 (the voltage of the power supply 1) and the reference voltage 42*a*, and then the duty of the duty variable transmitter 45 is adjusted by the output from the processing circuit 42. The output of the duty variable transmitter 45 and the output of the pulse generator 47 are led to a gate circuit constituted by the AND circuit 46. The switching of the energizing circuit 44 is performed in accordance with the output of the gate circuit constituted by the AND circuit 46, thereby controlling the energization of the solenoid 8.

Specifically, the processing circuit 42 with the reference voltage 42*a* provided thereto is supplied with the voltage from the rectifying circuit 41, more specifically from the power supply 1, and then supplies a control signal to the duty variable transmitter 45 in accordance with the supplied voltage. The duty of the duty variable transmitter 45 is then adjusted by the control signal from the processing circuit 42 supplied in accordance with the voltage of the power supply 1. This duty and the output of the pulse generator 47 are supplied to the AND circuit 46. That is, in accordance with this embodiment, the control signal output from the AND circuit 46 to the energizing circuit 44 is arranged to be variable in accordance with the voltage of the power supply 1, so that an average voltage supplied to the solenoid, or more specifically to the energizing circuit 44 can be regulated.

Accordingly, in the same manner as that of the control circuits of the first, second and third embodiments, it is not necessary to prepare a varying type of the control circuit 40 of this embodiment for coping with the power supply of varying voltage, so that the regulation or any other adjustments of the supply voltage by an user can be eliminated, and therefore a troublesome work to adjust the supply voltage can be eliminated.

Further, one type of the control circuit 40 can sufficiently cope with the power supply of varying voltage, so that a different type of the control circuit 40 is not required, thereby eliminating the necessity to select the control circuit for a different power supply. Therefore, it is possible to avoid various troubles such as malfunction and burning of the control circuit and the solenoid, due to an incorrect control circuit, thereby achieving ease of inventory management.

The description of each embodiment was made for the arrangement, where the voltage representative of an electrical energy applied to the solenoid, or the charging amount of the condenser is regulated. However, the present invention is not limited to this arrangement, but may be applied to, for example, the arrangement, where the parameter to be regulated is not a voltage but a current. Alternatively, within a practical range (e.g., a temperature range, in which the respective components or elements can be continuously used, and the range, in which the solenoid can be normally operated), even if the voltage is somewhat varied, the operation of the pump can be stabilized by regulating other parameters, for example, the attraction force to the solenoid and coil heating in accordance with the present invention conceived to regulate an electrical energy.

It may be arranged that the pump can change the energy (some kinds of the energy for regulation) supplied to the solenoid in plural stages.

This specification is by no means intended to restrict the present invention to the preferred embodiments set forth therein. Various modifications to the control circuit of the solenoid actuated pump of the present invention, as described herein, may be made by those skilled in the art without departing from the spirit and scope of the present invention as defined in the appended claims.

What is claimed is:

1. A control circuit of a solenoid actuated pump having a solenoid energized with electrical energy supplied from a power supply, which comprises:

a transformer; a rectifying circuit; a detecting means; a processing unit; an energizing circuit; and a data supplying unit;

wherein the electrical energy from the power supply is divided into said transformer and said rectifying circuit for generating a direct voltage, said processing unit is energized with the electrical energy supplied thereto via said transformer, and the voltage divided from the direct voltage generated by said rectifying circuit is detected by said detecting means;

said energizing circuit being constructed to energize said solenoid with an electrical energy supplied from said rectifying circuit;

said processing unit being constructed so as to generate a control signal in accordance with the value detected by said detecting means and a set value preset to said data supplying unit; and said control signal controlling said energizing circuit so that, even if the electrical energy supplied from the power supply is of an excessively low or high value, the voltage outputted from the energizing circuit is adjusted to a predetermined value for energizing the solenoid.

2. A control circuit of a solenoid actuated pump having a solenoid energized with electrical energy supplied from a power supply, which comprises:

a transformer; a rectifying circuit; a detecting means; a processing unit; an energizing circuit; and a data supplying unit; said detecting means including a detecting unit for dividing the voltage from said rectifying circuit, transforming the divided voltage and detecting the transformed voltage, and an analog-to-digital converter for converting the voltage detected by said detecting unit to a digital signal;

wherein the electrical energy is divided into said transformer and said rectifying circuit for generating a direct voltage, said processing unit is energized with the electrical energy supplied thereto via said transformer, and the voltage divided from the direct voltage generated by said rectifying circuit is detected by said detecting means;

said energizing circuit being constructed to energize said solenoid with an electrical energy supplied from said rectifying circuit;

said processing unit being constructed so as to generate a control signal in accordance with the value detected by said detecting means and a set value preset to said data supplying unit; and said control signal controlling said energizing circuit so that, even if the electric energy supplied from the power supply is of an excessively low or high value, the voltage outputted from the energizing circuit is adjusted to a predetermined value for energizing the solenoid.

3. A control circuit of a solenoid actuated pump as set forth in claim 1, wherein the electric energy supplied from the power supply has a voltage value in the range between 90 to 264 volts, and said voltage value supplied via said rectifying circuit is transformed to about 0 to 5 volts, so that the electric energy being of an excessively low or high value can be used.

4. A control circuit of a solenoid actuated pump as set forth in claim 2, wherein the electric energy supplied from the power supply has a voltage value in the range between 90 to 264 volts, and said voltage value supplied via said rectifying circuit is transformed to about 0 to 5 volts, so that the electric energy being of an excessively low or high value can be used.

5. A control circuit of a solenoid actuated pump as set forth in claim 1, wherein the control signal supplied to said energizing circuit is a signal for controlling an on-off duty ratio by switching the direct voltage supplied from said rectifying circuit.

6. A control circuit of a solenoid actuated pump as set forth in claim 2, wherein the control signal supplied to said energizing circuit is a signal for controlling an on-off duty ratio by switching the direct voltage supplied from said rectifying circuit.

7. A control circuit of a solenoid actuated pump as set forth in claim 3, wherein the control signal supplied to said energizing circuit is a signal for controlling an on-off duty ration by switching the direct voltage supplied from said rectifying circuit.

8. A control circuit of a solenoid actuated pump as set forth in claim 4, wherein the control signal supplied to said energizing circuit is a signal for controlling an on-off duty ratio by switching the direct voltage supplied from said rectifying circuit.

9. A control circuit of a solenoid actuated pump as set forth in claim 5, wherein a control system using said control signal uses a pulse width modulation mode or a phase modulation mode.

10. A control circuit of a solenoid actuated pump as set forth in claim 6, wherein a control system using said control signal uses a pulse width modulation mode or a phase modulation mode.

11. A control circuit of a solenoid actuated pump as set forth in claim 7, wherein a control system using said control signal uses a pulse width modulation mode or a phase modulation mode.

12. A control circuit of a solenoid actuated pump as set forth in claim 8, wherein a control system using said control signal uses a pulse width modulation mode or a phase modulation mode.

* * * * *